United States Patent [19]

Kameda et al.

[11] Patent Number: 4,663,642

[45] Date of Patent: May 5, 1987

[54] THERMOSENSITIVE RECORDING MATERIAL

[75] Inventors: Naomi Kameda, Susono; Kenji Uematsu, Numazu, both of Japan

[73] Assignee: Ricoh Company, Ltd., Tokyo, Japan

[21] Appl. No.: 831,456

[22] Filed: Feb. 20, 1986

[30] Foreign Application Priority Data

Feb. 23, 1985 [JP] Japan ..... 60-34981
Apr. 20, 1985 [JP] Japan ..... 60-84938

[51] Int. Cl.[4] ..... B41M 5/18

[52] U.S. Cl. ..... 346/217; 346/200; 346/214; 346/221; 346/226; 427/150; 427/151; 427/152

[58] Field of Search ..... 427/150–152; 346/200, 216, 217, 226, 221, 214

[56] References Cited

U.S. PATENT DOCUMENTS 4,425,161 1/1984 Shibahashi et al. ..... 427/150

*Primary Examiner*—Bruce H. Hess

*Attorney, Agent, or Firm*—Oblon, Fisher, Spivak, McClelland, & Maier

[57] ABSTRACT

A thermosensitive recording material comprises a support member, (b) a thermosensitive coloring layer formed on the support member, comprising a binder agent, a colorless or light-colored leuco dye and a color developer capable of inducing color formation is the leuco dye upon application of heat thereto, and (c) a protective layer formed on the thermosensitive coloring layer, comprising a binder agent, a filler and an ultraviolet-ray-absorbing benzotriazole derivative.

8 Claims, No Drawings

THERMOSENSITIVE RECORDING MATERIAL

BACKGROUND OF THE INVENTION

The present invention relates to a thermosensitive recording material, and more particularly to the improvement of a thermosensitive recording material comprising a support material and a thermosensitive coloring layer formed thereon, containing a colorless or light-colored leuco dye and a color developer capable of inducing color formation in the leuco dye upon application of heat thereto through a thermal reaction.

Conventional thermosensitive recording materials are provided with a thermosensitive coloring layer of which the main components are thermosensitive coloring components, on a support material such as paper, synthetic paper, or a plastic film, so that colored images are obtained by application of heat through a thermal head, thermal pen, laser beam, stroboscopic lamp, and the like. With this type of recording material, the recording can be obtained in a short time as compared with other recording materials, by using a comparatively simple device without the need for complicated processes such as developing and fixing. In addition to the above advantages, because of the advantages of low cost and small amount of noise and environmental pollution, this material has wide-scale utilization, not only as recording materials for copying books and documents, but also as recording materials for use with computers, facsimile machines, ticket vendors, recorders, and the like, and as recording labels.

In recent years, thermosensitive recording materials have gained further widespread application as recording materials in parallel with the progress in, in particular, the systemization of product systems and point of sale (POS) systems for product data and sales control.

The thermal color developing components used in this type of thermosensitive recording material usually comprise a coloring agent and a color developer capable of inducing color formation in the coloring agent upon application of heat thereto. Conventionally, as such coloring agents, leuco dyes having, for example, lactone, lactam, or spiropyran rings, are employed, and as such color developers, organic acids and phenolic acid materials are employed.

However, this type of recording material does not demonstrate satisfactory light resistance in image areas and the background, specifically because of the reduction in image density and the extreme discoloration of the background upon long-term exposure to fluorescent light or sunlight, especially in the application of labels in the systemization of POS. Conventionally, the addition of an ultraviolet-ray-absorbing compound, such as benzophenone, benzotriazole and salicylate, to the thermosensitive coloring layer, is commonly known as a method of improving the resistance to light. However, to simply include these ultraviolet-ray-absorbing compounds in the thermosensitive coloring layer gives rise to such a problem as fogging formation, due to an inadequate effect of absorption of ultraviolet rays, so that satisfactory results are not obtained.

SUMMARY OF THE INVENTION

It is therefore an object of the present invention to provide a thermosensitive recording material with superior resistance to light, or more specifically, a thermosensitive recording material of superior reliability almost free from color fading in the image areas and discoloring of the background during long-term exposure to fluorescent light and sunlight.

This object of the present invention is realized by a thermosensitive recording material comprising a support material, a thermosensitive coloring layer formed thereon, comprising as the main components a leuco due and a color developer capable of inducing color formation in the leuco dye upon application of heat, and a protective layer formed on the thermosensitive coloring layer, containing a benzotriazole derivative as an ultraviolet-ray-absorbing agent for improving the resistance to light of the images developed in the coloring layer.

Another object of the present invention is to provide a thermosensitive recording material of the above-mentioned type which, in addition to the above-mentioned advantages, has the advantages of having excellent thermal head matching properties and being free from the adhesion to thermal head of the dust coming from the protective layer or from the thermosensitive coloring layer during thermosensitive recording.

This object is achieved by a modified protective layer comprising (a) an upper layer and (b) a lower layer which is positioned on the side of the thermosensitive layer and contains the above-mentioned ultraviolet-ray-absorbing agent.

DETAILED DESCRIPTION OF THE PREFERRED EMBODIMENTS

In the present invention, an ultraviolet-ray-absorbing benzotriazole derivatives is employed in the protective layer. As such ultraviolet-ray-absorbing benzotriazole derivatives, conventionally known compounds, for example, compounds having the following formula are preferably employed:

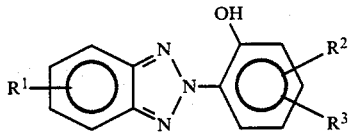

where $R^1$, $R^2$ and $R^3$ each represent hydrogen, a halogen atom, an alkyl group, an aryl group or a cycloalkyl group.

A list of specific examples of the benzotriazole derivatives for use in the present invention may include, but is not restricted to, the following:

2-(2′-hydroxy-5′-methylphenyl)benzotriazole,
2-(2′-hydroxy-3′-t-butyl-5′-methylphenyl)benzotriazole,
2-(2′-hydroxy-5′-t-octylphenyl)benzotriazole,
2-(2′-hydroxy-3′,5′-di-t-amylphenyl)benzotriazole,
2-(2′-hydroxy-3′,5-di-t-butylphenyl)benzotriazole,
2-(2′-hydroxy-3′-t-butyl-5′-methylphenyl)-5-chlorobenzotriazole,
2-(2′-hydroxy-3′,5′-di-t-butylphenyl)-5-chloro-benzotriazol, and
2-(2′-hydroxy-3′,5′-diphenylphenyl)benzotriazole.

As the leuco dyes for use in the present invention, any conventional leuco dyes for use in conventional thermosensitive recording material can be employed. For example, triphenylmethane-type leuco compounds, fluoran-type leuco compounds, phenothiazine-type leuco compounds, auramine-type leuco compounds and spiropyran-type leuco compounds are preferably employed. In particular, fluoran compounds having the following general formula are suitable for use in the present invention:

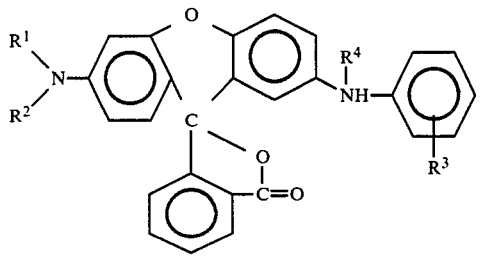

wherein $R^1$ and $R^2$ each represent an alkyl group or a clohexyl group, $R^3$ represents an alkyl group, a haloalkyl group or a halogen atom, and $R^4$ represents hydrogen or an alkyl group. It is preferable that the alkyl groups in the above formula have 1 to 8 carbon atoms.

Specific examples of the fluoran compounds which are preferably employed in the present invention are as follows:

3-diethylamino-7-o-chloro-anilinofluoran,
3-diethylamino-7-m-chloro-anilinofluoran,
3-di-n-butylamino-7-o-chloro-anilino-fluoran,
2-(N-3'-trifluoromethylphenyl)amino-6-diethylaminofluoran,
2-(N-3'-trifluoromethylphenyl-N-methyl)amino-6-diethylaminofluoran, and
3-diethylamino-7-(3'-trifluoromethylphenyl)amino-4'-chlorofluoran.

As the color developers for use in the present invention, conventional developers that are employed in the field of thermosensitive recording materials, such as phenolic compounds, sulfur-containing compounds, esters, carboxylic acid compounds, metal salt compounds and amine compounds, can be employed. Of such color developers, phenylthiourea derivatives having the following general formula are particularly suitable for use in the present invention:

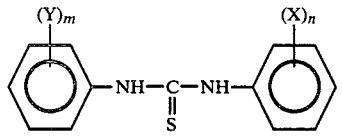

where X and Y each represent a halogen atom, an alkyl group or a haloalkyl group, and m and n each represent an integer of 0 to 3.

A list of specific examples of these types of phenylthiourea derivatives may include, but is not restricted to, N,N'-diphenylthiourea, 4,4'-diethylphenylthiourea, 4,4'-dibutylphenylthiourea, 4,4'-dichlorophenylthiourea, 3,3'-dichlorophenylthiourea, 3,3'-dimethylphenylthiourea and 3,3'-ditrichloro-methylphenylthiourea.

In the thermosensitive coloring layer, there can be contained one or more binder agents, fillers, surface active agents, thermofusible materials and lubricants.

Examples of the binder agents are water-soluble resins such as polyvinyl alcohol, hydroxyethylcellulose, methylcellulose, and isobutylene/maleic anhydride copolymer alkali salts; and latexes of polyurethane, styrene/butadiene copolymer and polyacrylic esters.

Examples of the fillers are inorganic fillers such as calcium carbonate, silica, titanium oxide, aluminum hydroxide, clay and talc fillers; and finely-divided organic fillers such as urea-formaldehyde resin filler and polystyrene filler.

Examples of the lubricants are higher fatty acids, the esters, amides and metal salts of higher fatty acids, and conventional waxes.

The protective layer comprises a binder agent, the previously described ultraviolet-ray-absorbing benzotriazole derivative and a filler. Specific examples of such binder agents are water-soluble resins such as polyvinyl alcohol, hydroxyethyl-cellulose, methylcellulose, and isobutylene/maleic anhydride copolymer alkali salt; and latexes of polyurethane, styrene/butadiene copolymer and polyacrylic esters.

In the protective layer, one or more fillers are contained, for example, inorganic fillers such as calcium carbonate, silica, titanium oxide, aluminum hydroxide, clay and talc; and finely-divided organic fillers such as urea-formaldehyde resin filler and polystyrene filler.

Further, lubricants such as higher fatty acids and the esters, amides and metal salts of higher fatty acids can be contained in the protective layer. When necessary, conventional surface active agents can also be contained in the protective layer.

In preparing the thermosensitive recording material according to the present invention, an aqueous dispersion comprising as the main components a leuco dye, a color developer and a binder agent is applied to a support material such as paper, synthetic paper and the like, to form a thermosensitive coloring layer. After the coated thermosensitive coloring layer is dried, a protective layer formation liquid comprising as the main components a water-soluble resin, a filler and an ultraviolet absorbing benzotriazole derivative is coated on the thermosensitive coloring layer.

It is preferable that the amounts of the leuco dye, color developer and binder agent in the thermosensitive coloring layer are, respectively, 5 to 30 wt. %, 40 to 80 wt. %, and 2 to 20 wt. %. Further, it is preferable that the the amount of deposition of the thermosensitive coloring layer be about 2 to 10 g/m$^2$.

It is preferable that the amounts of the water-soluble resin, filler and ultraviolet-ray-absorbing benzotriazole derivative in the protective layer be, respectively, 10 to 80 wt. %, 5 to 80 wt. %, and 5 to 60 wt. %. A preferable amount of deposition to form the protective layer is about 1 to 10 g/m$^2$.

When the protective layer comprises an upper layer and a lower layer which is situated on the side of the thermosensitive coloring layer, there can be contained in the upper layer one or more binder agents. Examples of the binder agents are water-soluble resins such as polyvinyl alcohol, hydroxyethylcellulose, methylcellulose, and isobutylene/maleic anhydride copolymer alkali salt; and latexes of polyurethane, styrene/butadiene copolymer and polyacrylic esters.

In the upper layer, there can be also contained fillers such as inorganic fillers such as calcium carbonate, silica, titanium oxide, aluminum hydroxide, clay and talc; and finely-divided organic fillers such as urea-formaldehyde resin filler and polystyrene filler.

Further, lubricants such as higher fatty acids and the esters, amides and metal salts of higher fatty acids can be contained in the upper layer. When necessary, conventional surface active agents can also be contained in the upper layer.

The lower layer comprises a binder agent and the ultraviolet-ray-absorbing benzotriazole derivative. As the binder agent, the same water-soluble resins as those employed in the upper layer can be employed.

When the protective layer comprises the above-mentioned upper layer and lower layer, it is preferable that the amounts of the water-soluble resin and ultraviolet-ray-absorbing benzotriazole derivative in the lower layer be, respectively, 30 to 90 wt. %, and 5 to 50 wt. %, and that the amounts of the water-soluble resin and filler in the upper layer be, respectively, 10 to 80 wt. % and 5 to 80 wt. %.

A preferable amount of deposition to form the lower layer is about 0.5 to 5 g/m$^2$, and a preferable amount of deposition to form the upper layer is about 1 to 10 g/m$^2$.

By referring to the following examples, the present invention will now be explained in detail.

EXAMPLE 1-1

[Preparation of Thermosensitive Coloring Layer Formation Liquid]

A dispersion A-1, a dispersion B-1 and a dispersion C-1 were separately prepared by grinding and dispersing the following respective components in a ball mill until the average particles of the solid components became 5 μm or less.

| | Parts by Weight |
|---|---|
| Dispersion A-1 | |
| 3-di-n-butylamino-7-o-chloro-anilinofluoran (Leuco Dye) | 10 |
| 10% aqueous solution of polyvinyl alcohol | 10 |
| Water | 30 |
| Dispersion B-1 | |
| 3,3'-dichlorophenylthiourea (Color Developer) | 3.5 |
| Calcium carbonate | 4.0 |
| 10% aqueous solution of polyvinyl alcohol | 5.5 |
| Water | 17.0 |
| Dispersion C-1 | |
| Octadecylcarbamoylbenzene (Thermofusible material) | 10 |
| 10% aqueous solution of polyvinyl alcohol | 10 |
| Water | 30 |

Dispersion A-1, dispersion B-1 and dispersion C-1 were mixed in a ratio by weight of 5:30:10, so that a thermosensitive coloring layer formation liquid was prepared.

[Preparation of Protective Layer Formation Liquid]

A dispersion D-1 and a dispersion E-1 were separately prepared by grinding and dispersing the following respective components in a ball mill until the particle sizes of the solid components became 5 μm or less.

| | Parts by Weight |
|---|---|
| Dispersion D-1 | |
| 10% aqueous solution of polyvinyl alcohol | 60 |
| Calcium carbonate | 4 |
| Zinc stearate (Lubricant) | 2 |
| Water | 62 |
| Dispersion E-1 | |
| [2-(2'-hydroxy-5'-t-octyl-phenyl)benzotriazole] | 10 |
| 10% aqueous solution of polyvinyl alcohol | 10 |

-continued

| | Parts by Weight |
|---|---|
| Water | 30 |

Dispersion D-1 and dispersion E-1 were mixed in a ratio by weight of 32:5. To this mixture, a cross linking agent for the polyvinyl alcohol, namely, a polyamide-epichlorohydrin resin, was added in an amount equal to 30 wt. % of the entire polyvinyl alcohol in the mixture. The mixture was then uniformly mixed, so that a protective layer formation liquid was prepared.

The first prepared thermosensitive coloring layer formation liquid was applied to a sheet of commercially available high quality paper (50 g/m$^2$) by a wire bar and was then dried, with a deposition of 0.5 g/m$^2$ on a dry basis, whereby a thermosensitive coloring layer was formed on the high quality paper.

Thereafter, the protective layer formation liquid was applied to the thermosensitive coloring layer with a deposition of 4 g/m$^2$ on a dry basis by a wire bar, so that a protective layer was formed on the thermosensitive coloring layer. Thus, a thermosensitive recording material No. 1-1 according to the present invention was prepared.

EXAMPLE 1-2

Example 1-1 was repeated except that the dispersion E-1 employed in Example 1-1 was replaced by a dispersion E-2 with the following formulation, whereby a thermosensitive recording material No. 1-2 according to the present invention was prepared.

| Dispersion E-2 | Parts by Weight |
|---|---|
| 2-(2'-hydroxy-5'-methylphenyl)benzotriazole | 10 |
| 10% aqueous solution of polyvinyl alcohol | 10 |
| Water | 30 |

EXAMPLE 1-3

Example 1-1 was repeated except that the dispersion A-1 and dispersion B-1 employed in Example 1-1 were respectively replaced by a dispersion A-2 and a dispersion B-2 with the following formulations, whereby a thermosensitive recording material No. 1-3 according to the present invention was prepared.

| | Parts by Weight |
|---|---|
| Dispersion A-2 | |
| 3-(N—methyl-N—cyclohexylamino)-6-methyl-7-anilinofluoran (Leuco Dye) | 10 |
| 10% aqueous solution of polyvinyl alcohol | 10 |
| Water | 30 |
| Dispersion B-2 | |
| Bisphenol A (Color Developer) | 3.5 |
| Calcium carbonate | 4.0 |
| 10% aqueous solution of polyvinyl alcohol | 5.5 |
| Water | 17.0 |

Comparative Example 1-1

Example 1-1 was repeated except that the dispersion E-1 employed in Example 1-1 was replaced by a comparative dispersion E-1 with the following formulation, which corresponded to the dispersion E-1 from which the ultraviolet-ray-absorbing agent was eliminated, whereby a comparative thermosensitive recording material No. 1-1 was prepared.

| Comparative Dispersion E-1 | Parts by Weight |
|---|---|
| 10% aqueous solution of polyvinyl alcohol | 10 |
| Water | 30 |

Comparative Example 1-2

Preparation of Thermosensitive Coloring Layer Formation Liquid

The dispersion A-2, dispersion B-2 which were prepared in Example 3 and the dispersion C-1 which were prepared in Example 1 were mixed in a ratio by weight of 5:30:10, so that a thermosensitive coloring layer formation liquid was prepared.

Preparation of Protective Layer Formation Liquid

The dispersion D-1 which was employed in Example 1-1 and the comparative dispersion E-1 which was employed in Comparative Example 1-1 were mixed in a ratio by weight of 32:5. To this mixture, a cross linking agent for the polyvinyl alcohol, a polyamide-epichlorohydrin resin, was added in an amount equal to 30 wt. % of the amount of the entire polyvinyl alcohol in the mixture. The mixture was then uniformly mixed, so that a protective layer formation liquid was prepared.

The first prepared thermosensitive coloring layer formation liquid was applied to a sheet of commercially available high quality paper (50 g/m$^2$) by a wire bar and was then dried, with a deposition of 0.5 g/m$^2$ on a dry basis, whereby a thermosensitive coloring layer was formed on the high quality paper.

Thereafter, the protective layer formation liquid was applied to the thermosensitive coloring layer with a deposition of 4 g/m$^2$ on a dry basis by a wire bar, so that a protective layer was formed on the thermosensitive coloring layer. Thus, a comparative thermosensitive recording material No. 1-2 was prepared.

The thermosensitive recording materials No. 1-1 through No. 1-3 according to the present invention and the comparative thermosensitive recording materials No. 1-1 and 1-2 were subjected to the following tests to investigate the color development capability, fading under sunlight and fading under fluorescent light.

(1) Color Development Capability

The image density of a colored image area developed at 140° C. using a thermal gradient tester, $D_{max}$, and the background density thereof, $D_{min}$, of each sample of the recording materials were measured by a Macbeth densitometer.

(2) Fading under Sunlight

A colored image area developed at 110° C. using the thermal gradient tester and the background thereof of each sample were exposed to direct sunlight for 30 hours. The changes in the image density of the image area and the background density thereof were measured by the Macbeth densitometer.

(3) Fading under Fluorescent Light

A colored image area developed at 110° C. using the thermal gradient tester and the background thereof of each sample were exposed to fluorescent light at 5000 lux for 240 hours. The changes in the image density of the image area and the background density of the background were measured by the Macbeth densitometer.

The results of these tests are shown in the following Table 1.

TABLE 1

| | | Example 1-1 | Example 1-2 | Example 1-3 | Comp. Example 1-1 | Comp. Example 1-2 |
|---|---|---|---|---|---|---|
| Color Development Capability | $D_{max}$ | 1.40 | 1.39 | 1.41 | 1.40 | 1.40 |
| | $D_{min}$ | 0.09 | 0.09 | 0.10 | 0.09 | 0.09 |
| Fading of Image Area under Sun-Light | Before Test | 1.30 | 1.28 | 1.29 | 1.29 | 1.28 |
| | After Test | 1.30 | 1.28 | 1.28 | 1.19 | 1.15 |
| Fading of Background under Sun-Light | Before Test | 0.09 | 0.09 | 0.10 | 0.09 | 0.09 |
| | After Test | 0.10 | 0.10 | 0.15 | 0.18 | 0.38 |
| Fading of Image Area under Fluorescent Light | Before Test | 1.30 | 1.28 | 1.29 | 1.29 | 1.28 |
| | After Test | 1.30 | 1.28 | 1.28 | 1.18 | 1.14 |
| Fading of Background Area under Fluorescent Light | Before Test | 0.09 | 0.09 | 0.10 | 0.09 | 0.09 |
| | After Test | 0.11 | 0.11 | 0.16 | 0.20 | 0.41 |

The above results clearly show that the images developed in the thermosensitive recording materials according to the present invention have extremely superior resistance to light (fading from sunlight and from fluorescent light exposure), and when specific leuco dyes and developers are combined in the thermosensitive recording materials, in particular, in Examples 1 and 2, this effect is even more pronounced.

EXAMPLE 2-1

[Preparation of Thermosensitive Coloring Layer Formation Liquid]

The dispersion A-1, dispersion B-1 and dispersion C-1 (which were employed in Example 1-1) were separately prepared by grinding and dispersing the following respective components in a ball mill until the average particles of the solid components became 5 μm or less.

| | Parts by Weight |
|---|---|
| Dispersion A-1 | |
| 3-di-n-butylamino-7-o-chloro-anilinofluoran (Leuco Dye) | 10 |
| 10% aqueous solution of polyvinyl alcohol | 10 |
| Water | 30 |
| Dispersion B-1 | |
| 3,3'-dichlorophenylthiourea (Color Developer) | 3.5 |
| Calcium carbonate | 4.0 |
| 10% aqueous solution of polyvinyl alcohol | 5.5 |
| Water | 17.0 |
| Dispersion C-1 | |
| Octadecylcarbamoylbenzene (Thermofusible material) | 10 |
| 10% aqueous solution of polyvinyl alcohol | 10 |
| Water | 30 |

Dispersion A-1, dispersion B-1 and dispersion C-1 were mixed in a ratio by weight of 5:30:10, so that a thermosensitive coloring layer formation liquid was prepared.

[Preparation of Lower Layer Formation Liquid]

The dispersion E-1 (which was the same as that employed in Example 1-1 was prepared by grinding and dispersing the following components in a ball mill until the particle sizes of the solid components became 5 μm or less.

| Dispersion E-1 | Parts by Weight |
|---|---|
| [2-(2'-hydroxy-5'-t-octylphenyl)benzotriazole] | 10 |
| 10% aqueous solution of polyvinyl alcohol | 10 |
| Water | 30 |

The above dispersion E-1 was added to 10% aqueous solution of polyvinyl alcohol in such a manner that the amount of the benzotriazole derivative (ultraviolet-ray-absorbing agent) contained in the dispersion E-1 was 0.5 parts by weight to 1 part by weight of the 10% aqueous solution of polyvinyl alcohol. To this mixture, a cross linking agent for polyvinyl alcohol, namely, a polyamide-epichlorohydrin resin, was added in an amount equal to 40 wt. % of the entire amount of the polyvinyl alcohol in the mixture. The mixture was uniformly mixed to prepare a lower layer formation liquid was prepared.

[Preparation of Upper Layer Formation Liquid]

A dispersion d-2 was prepared by grinding and dispersing the following components in a ball mill until the particle sizes of the solid components became 5 μm or less.

| Dispersion D-2 | Parts by Weight |
|---|---|
| 10% aqueous solution of polyvinyl alcohol | 100 |
| Silica | 5 |
| Zinc stearate (Lubricant) | 1 |
| Water | 54 |

To the dispersion D-2, a cross linking agent for polyvinyl alcohol, a polyamide-epichlorohydrin resin, was added in an amount equal to 40 wt. % of the entire polyvinyl alcohol in the mixture. The mixture was uniformly mixed, so that an upper layer formation liquid was prepared.

The first prepared thermosensitive coloring layer formation liquid was applied to a sheet of commercially available high quality paper (50 g/m$^2$) by a wire bar and was then dried, with a deposition of 0.5 g/m$^2$ on a dry basis, whereby a thermosensitive coloring layer was formed on the high quality paper.

Thereafter, the lower layer formation liquid was coated on the thermosensitive coloring layer with a deposition of 3 g/m$^2$ on a dry basis by a wire bar, so that a lower layer was formed on the thermosensitive coloring layer.

Finally, the upper layer formation liquid was coated on the lower layer with a deposition of 4 g/m$^2$ on a dry basis by a wire bar, so that an upper was formed on the lower layer, whereby a thermosensitive recording material No. 2-1 according to the present invention was prepared

EXAMPLE 2-2

Example 2-1 was repeated except that the dispersion E-1 employed in Example 2-1 was replaced by the dispersion E-2 (which was the same as the dispersion E-1 employed in Example 1-2) with the following formulation, whereby a thermosensitive recording material No. 2-2 according to the present invention was prepared.

| Dispersion E-2 | Parts by Weight |
|---|---|
| 2-(2'-hydroxy-5'-methylphenyl)benzotriazole | 10 |
| 10% aqueous solution of polyvinyl alcohol | 10 |
| Water | 30 |

EXAMPLE 2-3

Example 2-1 was repeated except that the dispersion A-1 and B-1 employed in Example 2-1 were respectively replaced by the dispersion A-2 and the dispersion B-2 with the following formulations (which were respectively the same as the dispersion A-2 and the dispersion 13-2 employed in Example 1-3), whereby a thermosensitive recording material No. 2-3 according to the present invention was prepared.

| | Parts by Weight |
|---|---|
| Dispersion A-2 | |
| 3-(N—methyl-N—cyclohexylamino)-6-methyl-7-anilinofluoran (Leuco Dye) | 10 |
| 10% aqueous solution of polyvinyl alcohol | 10 |
| Water | 30 |
| Dispersion B-2 | |
| Bisphenol A (Color Developer) | 3.5 |
| Calcium carbonate | 4.0 |
| 10% aqueous solution of polyvinyl alcohol | 5.5 |
| Water | 17.0 |

COMPARATIVE EXAMPLE 2-1

Example 2-1 was repeated except that the dispersion E-1 employed in Example 2-1 was replaced by the comparative dispersion E-1 with the following formulation (which was the same as the dispersion E-1 employed in Comparative Example 1-1), which corresponded to the dispersion E-1 from which the ultraviolet-ray-absorbing agent was eliminated, whereby a comparative thermosensitive recording material No. 2-1 was prepared.

| Comparative Dispersion E-1 | Parts by Weight |
|---|---|
| 10% aqueous solution of polyvinyl alcohol | 10 |
| Water | 30 |

COMPARATIVE EXAMPLE 2-2

Example 2-1 was repeated except that the lower layer formed in Example 2-1 was eliminated, whereby a comparative thermosensitive recording material No. 2-1 was prepared.

COMPARATIVE EXAMPLE 2-3

Example 2-1 was repeated except that the upper layer formed in Example 2-1 was eliminated, whereby a comparative thermosensitive recording material No. 2-3 was prepared.

COMPARATIVE EXAMPLE 2-4

[Preparation of Thermosensitive Coloring Layer Formation Liquid]

The dispersion A-2, dispersion B-2 which were prepared in Example 2-3 and the dispersion C-1 which were prepared in Example 2-1 were mixed in a ratio by weight of 5:30:10, so that a thermosensitive coloring layer formation liquid was prepared.

[Preparation of Lower Layer Formation Liquid]

The comparative dispersion E-1 (which was a dispersion prepared by eliminating [2-(2'-hydroxy-5'-t-octylphenyl)benzotriazole]from the dispersion E-1) with the following formulation was prepared in the same manner as in Comparative Example 2-1.

| Comparative Dispersion E-1 | Parts by Weight |
|---|---|
| 10% aqueous solution of polyvinyl alcohol | 10 |
| Water | 30 |

To the comparative dispersion E-1, a cross linking agent for polyvinyl alcohol, a polyamide-epichlorohydrin resin, was added in an amount equal to 40 wt. % of the entire polyvinyl alcohol in the mixture. The mixture was uniformly mixed to prepare a lower layer formation liquid was prepared.

[Preparation of Upper Layer Formation Liquid]

The dispersion D-1 (which was the same as that employed in Example 2-1) with the following formulation was prepared in the same manner as in Example 2-3.

| Dispersion D-1 | Parts by Weight |
|---|---|
| 10% aqueous solution of polyvinyl alcohol | 60 |
| Calcium carbonate | 4 |
| Lubricant | 2 |
| Water | 62 |

To the dispersion D-1, a cross linking agent for polyvinyl alcohol, a polyamide-epichlorohydrin resin, was added in an amount equal to 40 wt. % of the entire polyvinyl alcohol. The mixture was uniformly mixed, so that an upper layer formation liquid was prepared.

The first prepared thermosensitive coloring layer formation liquid was applied to a sheet of commercially available high quality paper (50 g/m$^2$) by a wire bar and was then dried, with a deposition of 0.5 g/m$^2$ on a dry basis, whereby a thermosensitive coloring layer was formed on the high quality paper.

Thereafter, the lower layer formation liquid was coated on the thermosensitive coloring layer with a deposition of 3 g/m$^2$ on a dry basis by a wire bar, so that a lower layer was formed on the thermosensitive coloring layer.

Finally, the upper layer formation liquid was coated on the lower layer with a deposition of 4 g/m$^2$ on a dry basis by a wire bar, so that an upper was formed on the lower layer, whereby a comparative thermosensitive recording material No. 2-3 was prepared.

The thermosensitive recording materials No. 2-1 through No. 2-3 according to the present invention and the comparative thermosensitive recording materials No. 2-1 through No. 2-4 were subjected to the following tests to investigate the color development capability, fading under sunlight and resistance to oil. In addition, the thermal head matching properties of each recording material were also inspected.

(1) Color Development Capability

The image density of a colored image area developed by application of a thermal energy of 0.85 mJ using a printing simulator (made by Matsushita Electronic Components Co., Ltd., $D_{max}$, and background density thereof, $D_{min}$, of each sample were measured by a Macbeth densitometer.

(2) Fading under Sunlight

A colored image area developed by application of a thermal energy of 0.71 mJ and the background thereof of each sample were exposed to direct sunlight for 30 hours. The changes in the image density of the image area and the background density of background were measured by the Macbeth densitometer.

(3) Resistance to Oil

Cotton-seed oil was applied to the colored image area which was developed by application of a thermal energy of 0.71 mJ and the background thereof. The image area and background thereof were exposed to fluorescent light at 5000 lux for 24 hours. The changes in the image area and background were visually inspected.

(4) Thermal Head Matching Properties

Thermal printing was carried out with a length of 1 m on each thermosensitive recording material under application of a thermal energy of 0.71 mJ using the printing simulator, so that the thermal head matching properties, specifically sticking to each recording material of dusty materials coming from recording material and adhering of such materials to the thermal head during thermal printing were investigated.

The results of these tests are shown in Table 2.

TABLE 2

| | | Example 1 | Example 2 | Example 3 | Comp. Example 1 | Comp. Example 2 | Comp. Example 3 | Comp. Example 4 |
|---|---|---|---|---|---|---|---|---|
| Color Development Capability | $D_{max}$ | 1.38 | 1.38 | 1.37 | 1.38 | 1.38 | 1.37 | 1.38 |
| | $D_{min}$ | 0.09 | 0.09 | 0.09 | 0.09 | 0.09 | 0.09 | 0.09 |
| Fading of Image Area under Sunlight | Before Test | 1.35 | 1.35 | 1.34 | 1.34 | 1.35 | 1.34 | 1.35 |
| | After Test | 1.35 | 1.35 | 1.32 | 1.19 | 1.18 | 1.18 | 1.17 |
| Fading of Background under Sunlight | Before Test | 0.09 | 0.09 | 0.09 | 0.09 | 0.09 | 0.09 | 0.09 |
| | After Test | 0.10 | 0.10 | 0.16 | 0.14 | 0.14 | 0.15 | 0.38 |
| Resistance to Oil | Before Test | o | o | o | o | Δ | o | Δ |
| | After Test | o | o | o | o | x | o | Δ |
| Head Matching | | o | o | o | o | o | x | o |

TABLE 2-continued

| | Example 1 | Example 2 | Example 3 | Comp. Example 1 | Comp. Example 2 | Comp. Example 3 | Comp. Example 4 |
|---|---|---|---|---|---|---|---|
| Properties | | | | | | | |

Remarks:
(1) In the resistance to the oil, o denotes no decoloring of the image area (or the background); Δ denotes slight decoloring and x denotes considerable decoloring.
(2) In the thermal head matching properties, o denotes excellent thermal head matching properties, and x denotes poor thermal head matching properties.

The above results clearly show that the images developed in the thermosensitive recording materials according to the present invention have extremely superior resistance to light and oil, and the recording materials themselves are excellent in the thermal head matching properties.

What is claimed is:

1. A thermosensitive recording material comprising a support member, (b) a thermosensitive coloring layer formed on said support member, comprising a colorless or light-colored leuco dye, a color developer capable of inducing color formation in said leuco dye upon application of heat thereto and a binder agent, and (c) a protective layer formed on said thermosensitive coloring layer, comprising a binder agent, a filler and an ultraviolet-ray-absorbing benzotriazole derivative, wherein said protective layer comprises an upper layer and a lower layer, said lower layer being disposed on the side of said thermosensitive coloring layer, and comprising said binder agent and said benzotriazole derivative, and said upper layer being disposed on said lower layer and comprising said binder agent and said filler.

2. A thermosensitive recording material as claimed in claim 1, wherein said ultraviolet-ray-absorbing benzotriazole derivative is a compound having the formula,

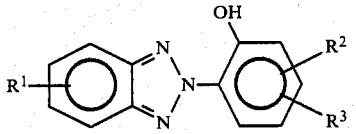

wherein $R^1$, $R^2$ and $R^3$ each represent hydrogen, a halogen atom, an alkyl group, an aryl group or a cycloalkyl group.

3. A thermosensitive recording material as claimed in claim 1, wherein said leuco dye is a leuco dye having the formula (I),

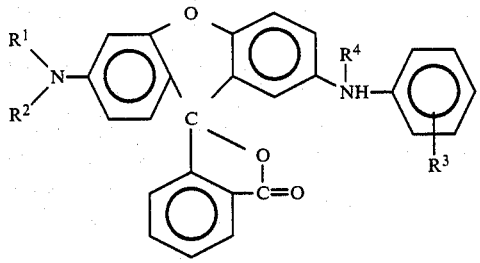

(I)

wherein $R^1$ and $R^2$ each represent an alkyl group or a cyclohexyl group; $R^3$ represents a haloalkyl or a halogen atom; and $R^4$ represents hydrogen or an alkyl group; and said color developer is a phenylthiourea having the formula (II),

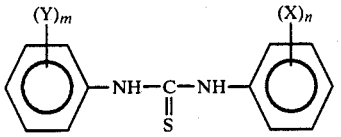

(II)

where X and Y each represent a halogen atom, an alkyl group or a haloalkyl group; and m and n each represent an integer of 0 to 3.

4. A thermosensitive recording material as claimed :n claim 1, wherein the amounts of said leuco dye, said color developer and said binder agent in said thermosensitive coloring layer are, respectively, 5 to 30 wt. %, 40 to 80 wt. % and 2 to 20 wt. %.

5. A thermosensitive recording material as claimed in claim 1, wherein said binder agent in said lower and upper layers is a water-soluble resin, the amounts of said water-soluble resin and said ultraviolet-ray-absorbing benzotriazole derivative in said lower layer are, respectively, 30 to 90 wt. % and 5 to 50 wt. %, and the amounts of said water-soluble resin and said filler in said upper layer are, respectively, 10 to 80 wt. % and 5 to 80 wt. %.

6. A thermosensitive recording material as claimed in claim 1, wherein said ultraviolet-ray-absorbing benzotriazole derivative is selected from the group consisting of:

2-(2'-hydroxy-5'-methylphenyl)benzotriazole,
2-(2'-hydroxy-3'-t-butyl-5'-methylphenyl)benzotriazole,
2-(2'-hydroxy-5'-t-octylphenyl)benzotriazole,
2-(2'-hydroxy-3',5'-di-t-amylphenyl)benzotriazole,
2-(2'-hydroxy-3',5'-di-t-butylphenyl)benzotriazole,
2-(2'-hydroxy-3'-t-butyl-5'-methylphenyl)-5-chlorobenzotriazole,
2-(2'-hydroxy-3',5'-di-t-butylphenyl)-5-chloro-benzotriazole, and
2-(2'-hydroxy-3',5-diphenylphenyl)benzotriazole.

7. A thermosensitive recording material as claimed in claim 1, wherein said leuco dye is selected from the group consisting of:

3-diethylamino-7-o-chloro-anilinofluoran,
3-diethylamino-7-m-chloro-anilinofluoran,
3-di-n-butylamino-7-o-chloro-anilino-fluoran,
2-(N-3'-trifluoromethylphenyl)amino-6-diethylamino-fluoran,
2-(N-3'-trifluoromethylphenyl-N-methyl)amino-6-diethylaminofluoran, and
3-diethylamino-7-(3'-trifluoromethylphenyl)amino-4'-chlorofluoran.

8. A thermosensitive recording material as claimed in claim 1, wherein said phenylthiourea is selected from the group consisting of N, N'-diphenylthiourea, 4,4'-diethylphenylthiourea, 4,4'-dibutylphenylthiurea, 4,4'-dichlorophenylthiourea, 3,3'-dichlorophenyl-thiourea, 3,3'-dimethylphenylthiourea and 3,3'-ditrichloromethylphenylthiourea.

* * * * *